US011976246B1

(12) United States Patent
Reardon et al.

(10) Patent No.: US 11,976,246 B1
(45) Date of Patent: May 7, 2024

(54) THERMAL CONVERSION OF PLASTIC WASTE INTO ENERGY

(71) Applicant: CONVERSION ENERGY SYSTEMS, INC., Oak Brook, IL (US)

(72) Inventors: Daniel Reardon, Frontenac, MO (US); Roger Masterson, Belleville, IL (US)

(73) Assignee: Conversion Energy Systems, Inc., Oak Brook, IL (US)

( * ) Notice: Subject to any disclaimer, the term of this patent is extended or adjusted under 35 U.S.C. 154(b) by 0 days.

(21) Appl. No.: 18/112,383

(22) Filed: Feb. 21, 2023

Related U.S. Application Data

(60) Provisional application No. 63/446,916, filed on Feb. 20, 2023, provisional application No. 63/444,688, filed on Feb. 10, 2023.

(51) Int. Cl.

| | |
|---|---|
| ***C10J 3/48*** | (2006.01) |
| ***C10J 3/32*** | (2006.01) |
| ***C10J 3/38*** | (2006.01) |
| ***C10J 3/42*** | (2006.01) |
| ***C10J 3/72*** | (2006.01) |
| ***C10J 3/84*** | (2006.01) |

(52) U.S. Cl.

CPC ..... *C10J 3/487* (2013.01); *C10J 3/32* (2013.01); *C10J 3/38* (2013.01); *C10J 3/42* (2013.01); *C10J 3/723* (2013.01); *C10J 3/84* (2013.01); *C10J 2200/09* (2013.01); *C10J 2200/158* (2013.01); *C10J 2200/36* (2013.01); *C10J 2300/0946* (2013.01); *C10J 2300/0956* (2013.01); *C10J 2300/0976* (2013.01); *C10J 2300/165* (2013.01); *C10J 2300/1671* (2013.01); *C10J 2300/1869* (2013.01); *C10J 2300/1884* (2013.01)

(58) Field of Classification Search

CPC ..... C10J 3/34; C10J 2200/00; C10J 2200/09; C10J 2200/36; C10J 2200/39; C10J 3/487; C10J 3/32; C10J 3/38

See application file for complete search history.

(56) References Cited

U.S. PATENT DOCUMENTS

| | | | | | |
|---|---|---|---|---|---|
| 1,078,071 | A | * | 11/1913 | Tait | C10J 3/34 122/374 |
| 2,991,281 | A | * | 7/1961 | Bradshaw | C08B 1/10 162/DIG. 12 |
| 5,408,824 | A | | 4/1995 | Schlote | |
| 5,560,196 | A | | 10/1996 | Schlote | |
| 5,997,595 | A | * | 12/1999 | Yokohama | C10J 3/506 239/487 |
| 6,051,109 | A | * | 4/2000 | Kappel | D21C 9/10 422/213 |

(Continued)

FOREIGN PATENT DOCUMENTS

| | | | |
|---|---|---|---|
| CN | 210332682 U | * | 4/2020 |
| CN | 111690438 A | * | 9/2020 |

(Continued)

*Primary Examiner* — Imran Akram

(74) *Attorney, Agent, or Firm* — Harness, Dickey & Pierce, P.L.C.; Anthony G. Fussner

(57) ABSTRACT

Disclosed are exemplary embodiments of thermal conversion reactors and assemblies/units, systems, and methods including the same for thermally converting landfill-bound plastic waste (broadly, polymeric materials) into electrical energy.

19 Claims, 16 Drawing Sheets

(56) References Cited

U.S. PATENT DOCUMENTS 6,161,490 A * 12/2000 Fujinami ..... C10J 3/482 110/259
6,668,539 B2 12/2003 Schlote
6,938,562 B2 9/2005 Pope
6,996,971 B2 2/2006 Schlote
7,080,517 B2 7/2006 Schlote
7,708,522 B2 5/2010 Schlote
7,866,937 B2 1/2011 Schlote
7,914,280 B2 3/2011 Schlote et al.
8,736,127 B2 5/2014 Schlote
8,919,265 B2 12/2014 Offutt
9,062,597 B2 6/2015 Schlote
9,545,590 B2 1/2017 Garrett et al.
9,989,251 B2 6/2018 Tummillo et al.
2003/0000144 A1* 1/2003 Maton ..... C10J 3/487 252/373
2003/0139543 A1* 7/2003 Wilhelm ..... C08G 63/785 526/65
2004/0182294 A1* 9/2004 Hahn ..... C10J 3/14 110/229
2004/0261316 A1* 12/2004 Weaver ..... C10J 3/723 48/209
2005/0056951 A1* 3/2005 Wynes ..... B01F 35/712 210/221.2
2005/0239199 A1* 10/2005 Kunas ..... B01F 35/51 435/297.1
2008/0209807 A1* 9/2008 Tsangaris ..... F23G 5/027 48/89
2009/0293783 A1* 12/2009 Shuman ..... F23G 5/444 110/255
2010/0107493 A1* 5/2010 Weaver ..... C10J 3/42 48/86 R
2012/0196336 A1* 8/2012 McCutchen ..... C12N 13/00 137/803
2016/0237355 A1* 8/2016 Bynum ..... C01B 3/34

FOREIGN PATENT DOCUMENTS

CN 212092270 U * 12/2020
CN 213254434 U * 5/2021
CN 113136235 A * 7/2021 ..... B07B 1/08
CN 214528868 U * 10/2021
CN 110180491 B * 2/2022 ..... B01J 20/041
CN 216191392 U * 4/2022
CN 216296330 U * 4/2022
CN 217699118 U * 11/2022

* cited by examiner

THERMAL CONVERSION OF PLASTIC WASTE INTO ENERGY

CROSS-REFERENCE TO RELATED APPLICATIONS

This application claims priority to and the benefit of U.S. Provisional Patent Application No. 63/444,688 filed Feb. 10, 2023 and U.S. Provisional Patent Application No. 63/446,916 filed Feb. 20, 2023. The entire disclosures of the above applications are incorporated herein by reference.

FIELD

The present disclosure relates to thermal conversion of plastic waste (broadly, polymeric material) into energy, and more particularly (but not exclusively) to thermal conversion processes under gasification technology to convert landfill-bound plastic waste into energy.

BACKGROUND

This section provides background information related to the present disclosure which is not necessarily prior art.

Conventional thermal conversion processes may be used to convert a wide array of feedstocks into energy and fuels. For example, a conventional system may be used to thermally convert reclaimed "clean" plastic into energy and fuels.

DRAWINGS

The drawings described herein are for illustrative purposes only of selected embodiments and not all possible implementations, are not intended to limit the scope of the present disclosure.

FIG. 1 is a perspective view of a thermal conversion reactor (e.g., a gasifier, etc.) usable in a system for thermally converting (e.g., under gasification technology, etc.) landfill-bound plastic waste (broadly, polymeric material) into process gas (e.g., syngas, etc.), for use as a fuel by a generator (e.g., microturbine genset, other genset or generator, etc.) for the generation of electrical power according to exemplary embodiments of the present disclosure.

FIG. 2 is another perspective view of the thermal conversion reactor shown in FIG. 1 wherein the reactor's outer wall/shell is transparent and insulation is removed for clarity to illustrate internal structures between the inner and outer reactor walls. The internal structures (e.g., baffles, racetracks, raceways, spiral guide vanes, etc.) are configured for directing feedstock material and process gas in a circulating vortex, forced-convection, high-mix flow to improve reaction efficiency according to exemplary embodiments of the present disclosure.

FIG. 3 is another perspective view of the thermal conversion reactor shown in FIG. 2 wherein the reactor's inner reactor wall and internal structures have also been removed for clarity to illustrate rotatable plates within the reaction chamber of the thermal conversion reactor. The reactor plates are configured to rotate axially in the reactor chamber such that feedstock is conveyed through the reactor via openings in the reactor plates.

Figure 11:
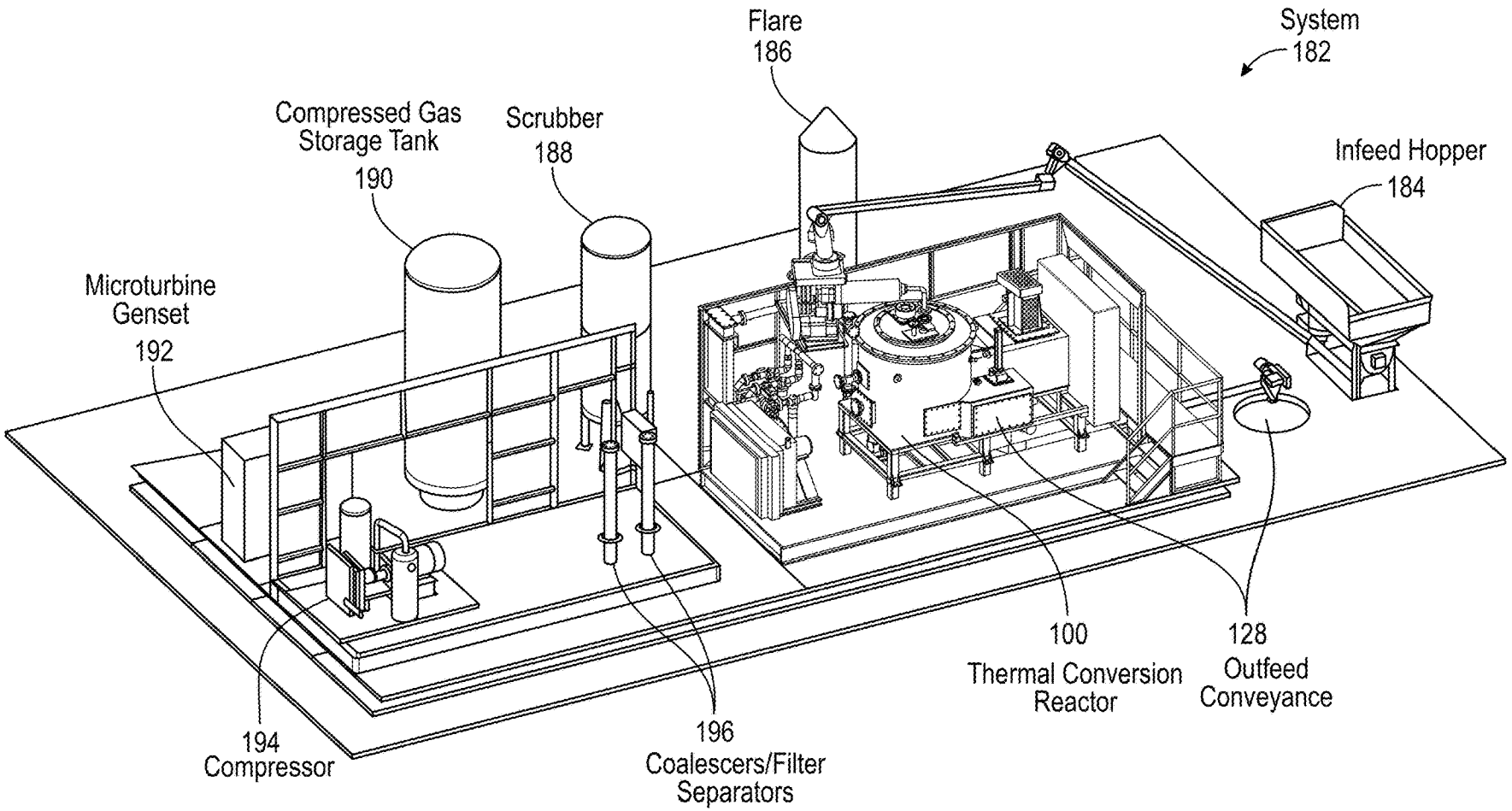
Figure 12:
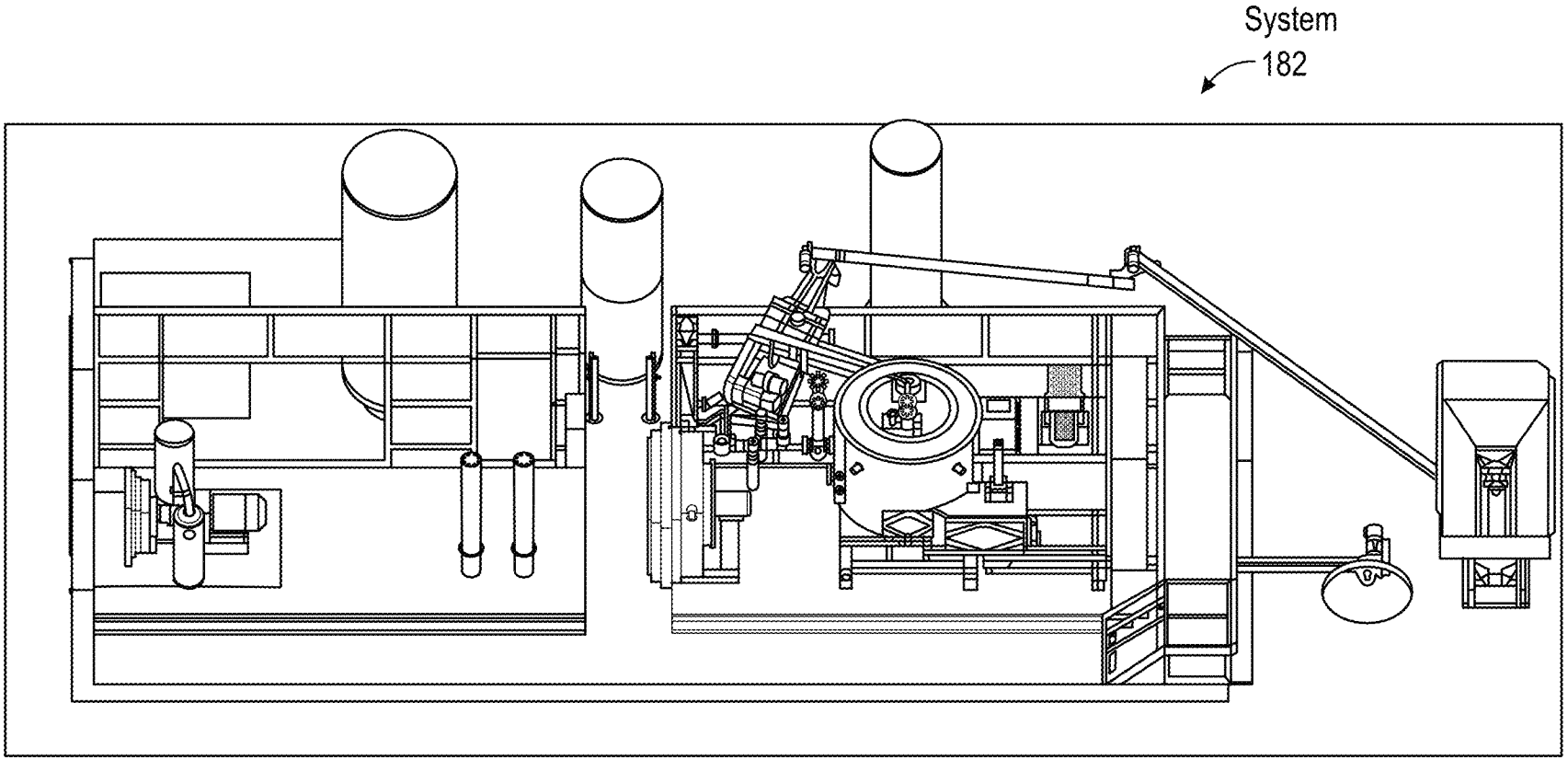

FIGS. 11 and 12 are perspective views of an exemplary embodiment of a system operable for the thermal conversion of landfill-bound plastic waste (broadly, polymeric material) into electrical energy. As shown, the system includes the unit shown in FIG. 4 including the thermal conversion reactor and outfeed conveyance shown in FIGS. 1-7, and additional system components, such as an infeed hopper, flare, scrubber, compressed gas storage tank, microturbine genset, compressor, and coalescers/filter separators.

Figure 13:
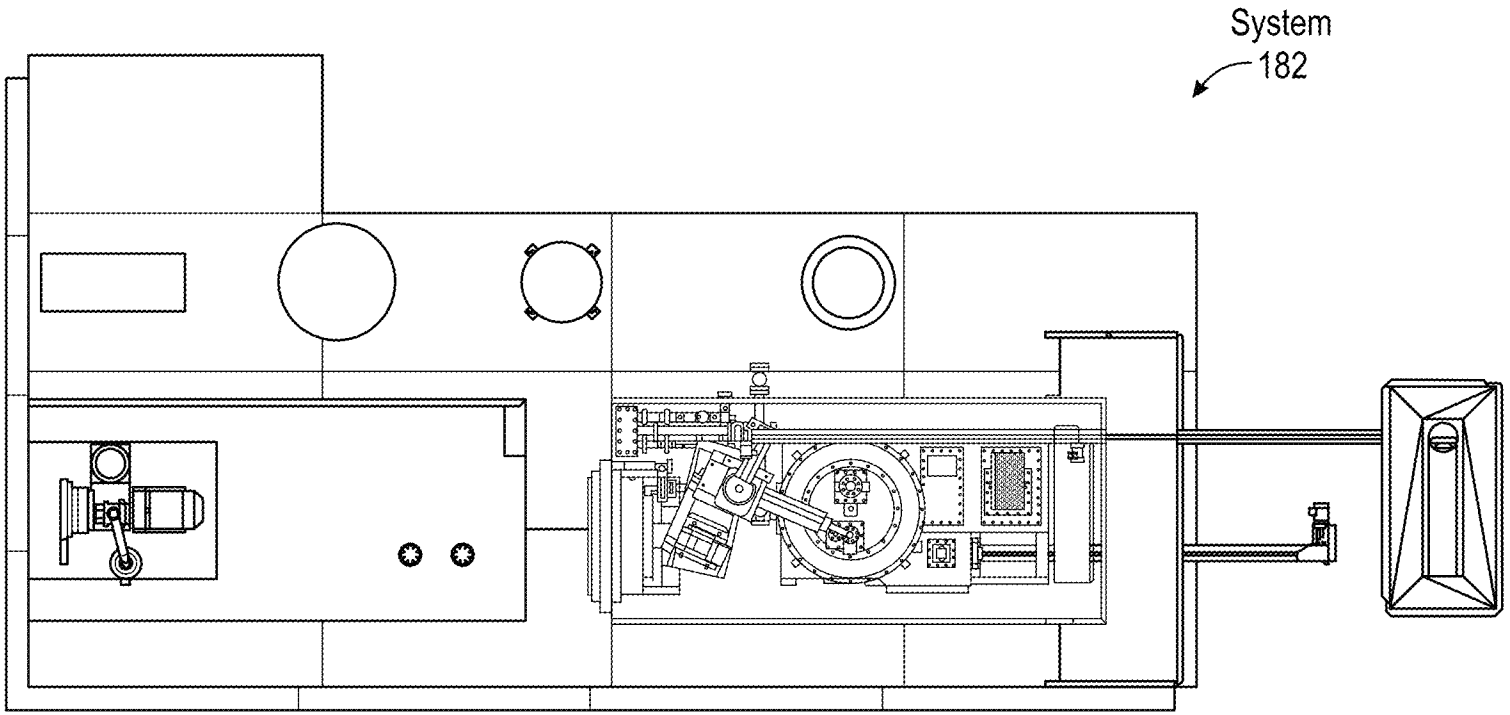

FIG. 13 is a top view of the system shown in FIGS. 11 and 12.

Figure 14:
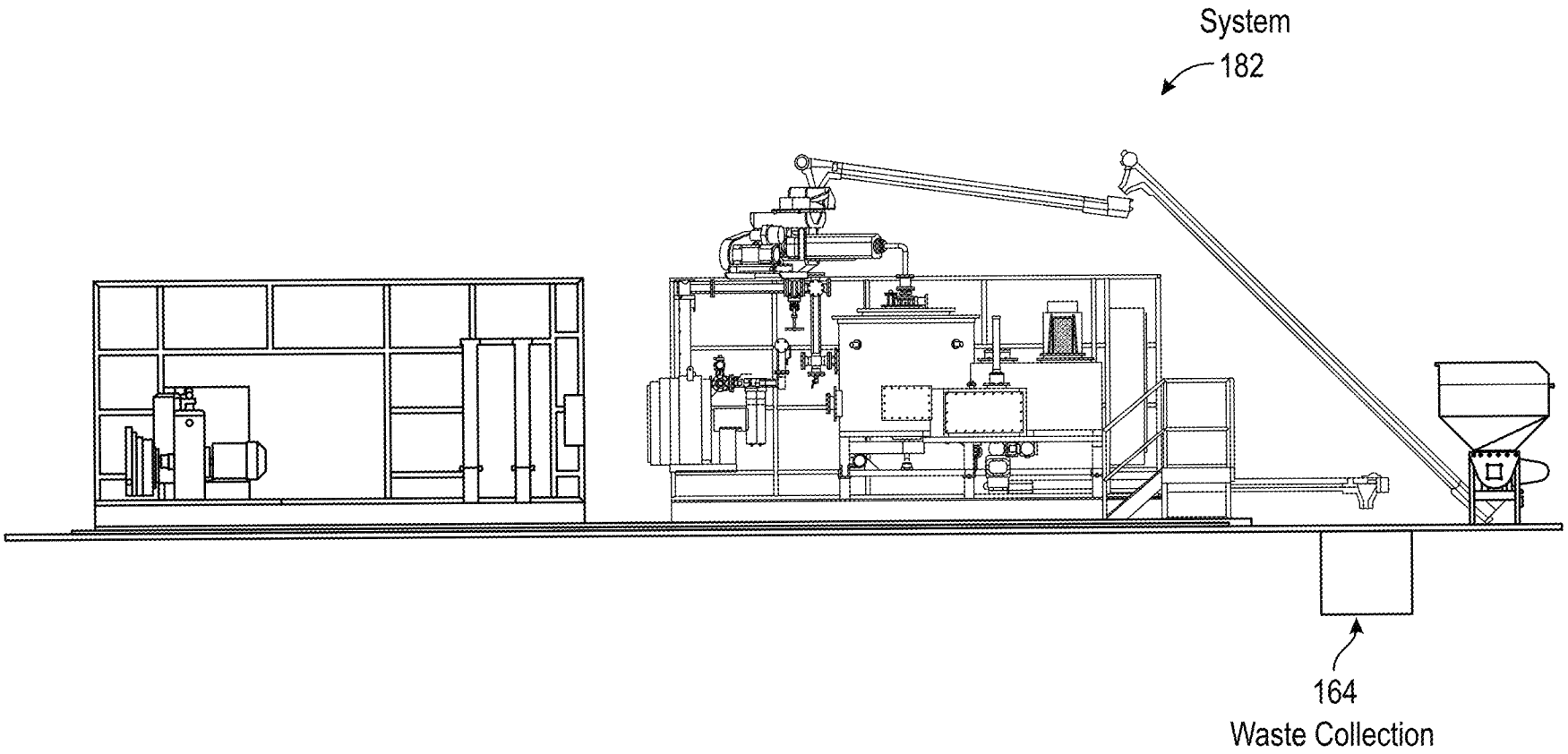

FIG. 14 is a side view of the system shown in FIGS. 11 and 13.

Figure 15:
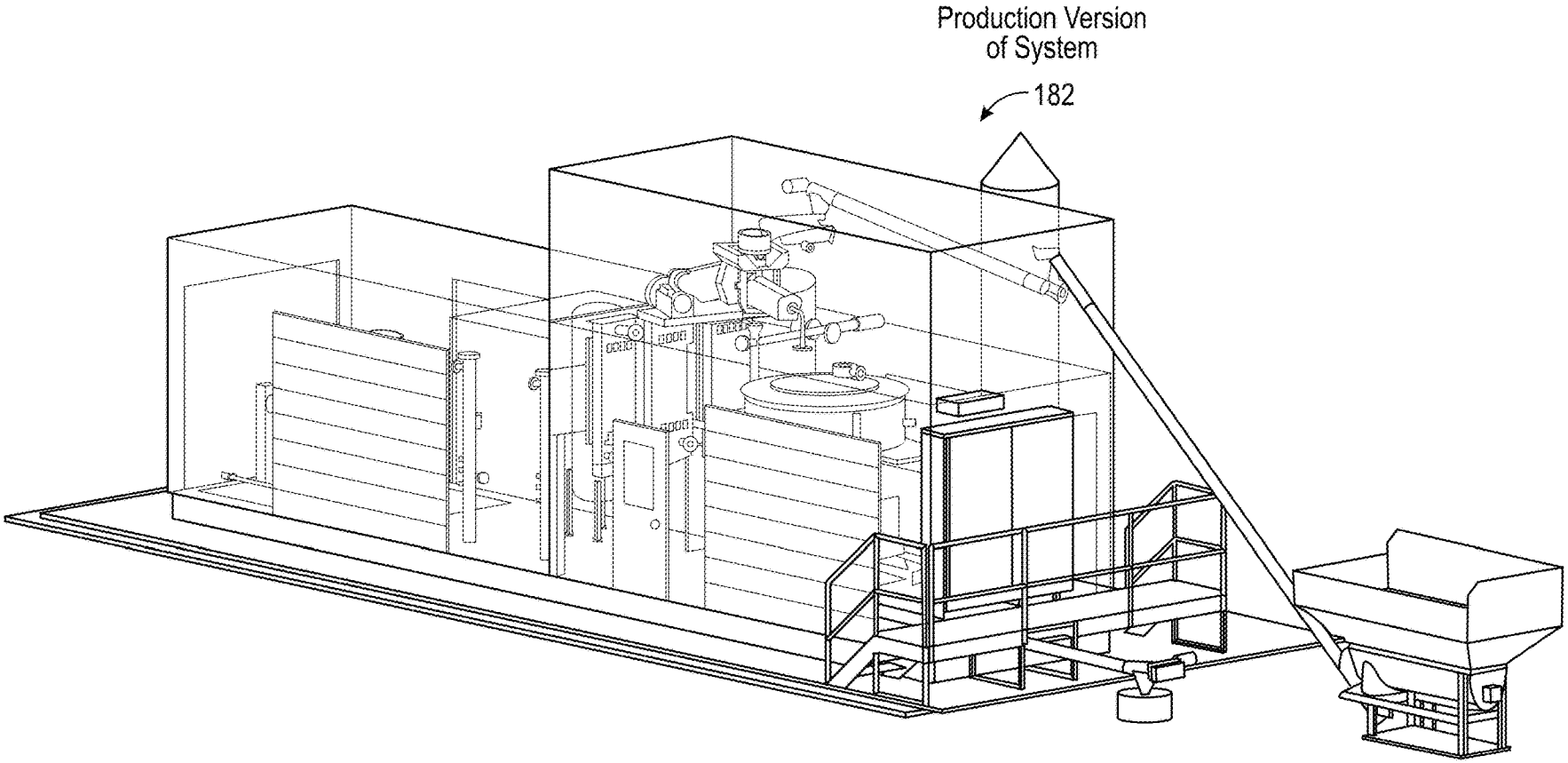
Figure 16:
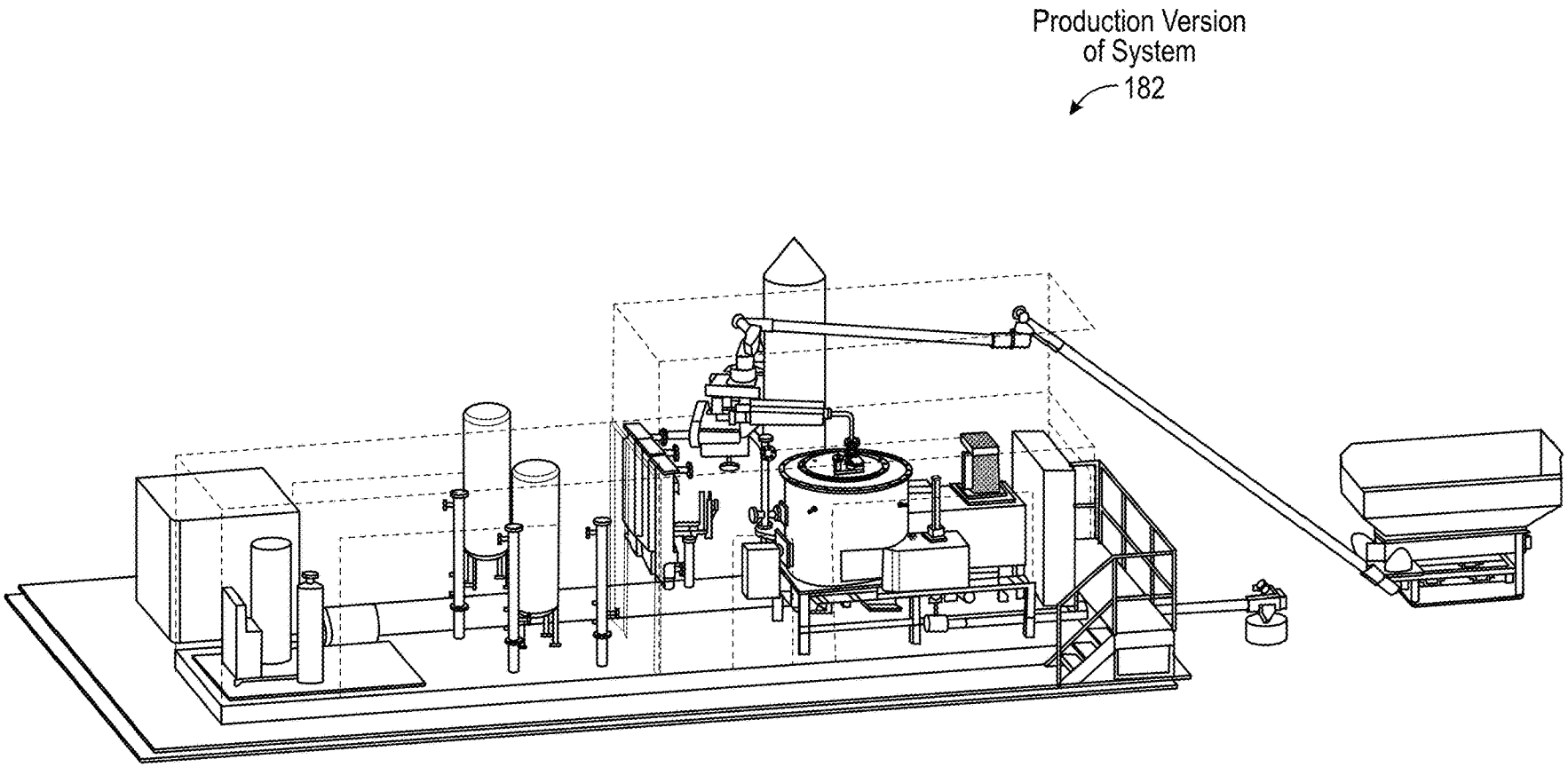

FIGS. 15 and 16 illustrate a production version of the system shown in FIGS. 11-14 according to an exemplary embodiment of the present disclosure.

Corresponding reference numerals may indicate corresponding (though not necessarily identical) parts throughout the several views of the drawings.

DETAILED DESCRIPTION

Example embodiments will now be described more fully with reference to the accompanying drawings.

As noted in the background above, conventional thermal conversion processes may be used to convert a wide array of feedstocks into energy and fuels. But conventional systems are limited in use for thermally converting only reclaimed "clean" plastic into energy and fuels. And the successful implementation of a thermal conversion process under gasification technology to convert landfill-bound plastic waste into energy has been elusive to others. Accordingly, there is a need in the art for thermal conversion of landfill-bound plastic waste into energy, e.g., in order to provide a favorable economic and environmental impact, etc.

After recognizing the above, exemplary embodiments were developed and/or are disclosed herein for the thermal conversion of landfill-bound plastic waste (broadly, polymeric materials) into energy. As disclosed herein, exemplary embodiments are configured for thermally converting (e.g., under gasification technology, etc.) landfill-bound plastic waste (e.g., polyethylene terephthalate (PET), high-density polyethylene (HDPE), polyvinyl chloride (PVC), low-density polyethylene (LDPE), polypropylene (PP), polystyrene (PS), combinations thereof, other plastics, other polymeric materials, etc.) into electrical energy.

Disclosed are exemplary embodiments of systems, assemblies, apparatus/units, and methods for thermally converting landfill-bound plastic waste (broadly, polymeric materials)

into process gas. The process gas may be subsequently conditioned for use as a fuel by a generator (e.g., microturbine genset, other genset or generator, etc.) for the generation of electrical power. In addition to the electric power generation and electrical power savings therefrom, exemplary embodiments disclosed herein also provide the very important benefit of reducing the landfill requirements for disposal of plastic.

Exemplary embodiments disclosed herein may further provide one or more additional advantages over conventional technology. In exemplary embodiments, the reaction chamber of the thermal conversion reactor (e.g., thermal conversion reactor 100 (FIGS. 1-3), etc.) utilizes internal structures (e.g., baffles, racetracks, raceways, spiral guide vanes, internal structures 104 (FIG. 2), etc.) between the inner and outer reactor walls, which internal structures are configured for directing feedstock material and process gas in a circulating vortex, forced-convection, high-mix flow to improve reaction efficiency. In exemplary embodiments, the reaction chamber of the thermal conversion reactor utilizes rotatable plates (e.g., dynamic perforated plates, plates 108 (FIGS. 3 and 7), etc.) within the reaction chamber to increase reaction chamber surface area, improve reaction efficiency, and convey non-reacting byproduct to appropriate outfeed. In addition, the unit or assembly (e.g., unit 168 (FIGS. 8-10, etc.) including the thermal conversion reactor (e.g., thermal conversion reactor 100 (FIGS. 1-3), etc.) is preferable portable and smaller in scale than conventional technology, thereby enabling the unit to fit more easily into customers' site requirements.

Figure 1:
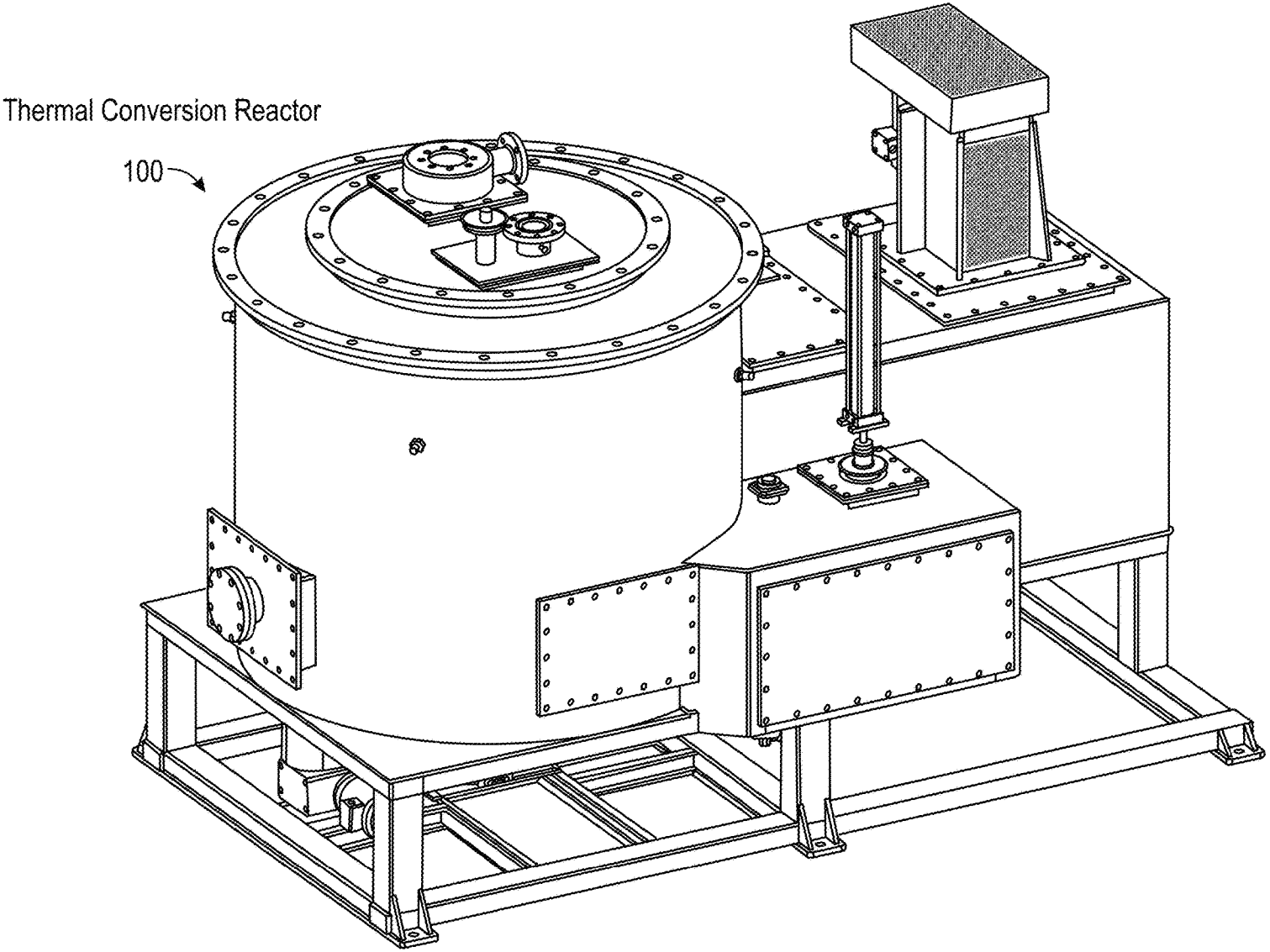
Figure 2:
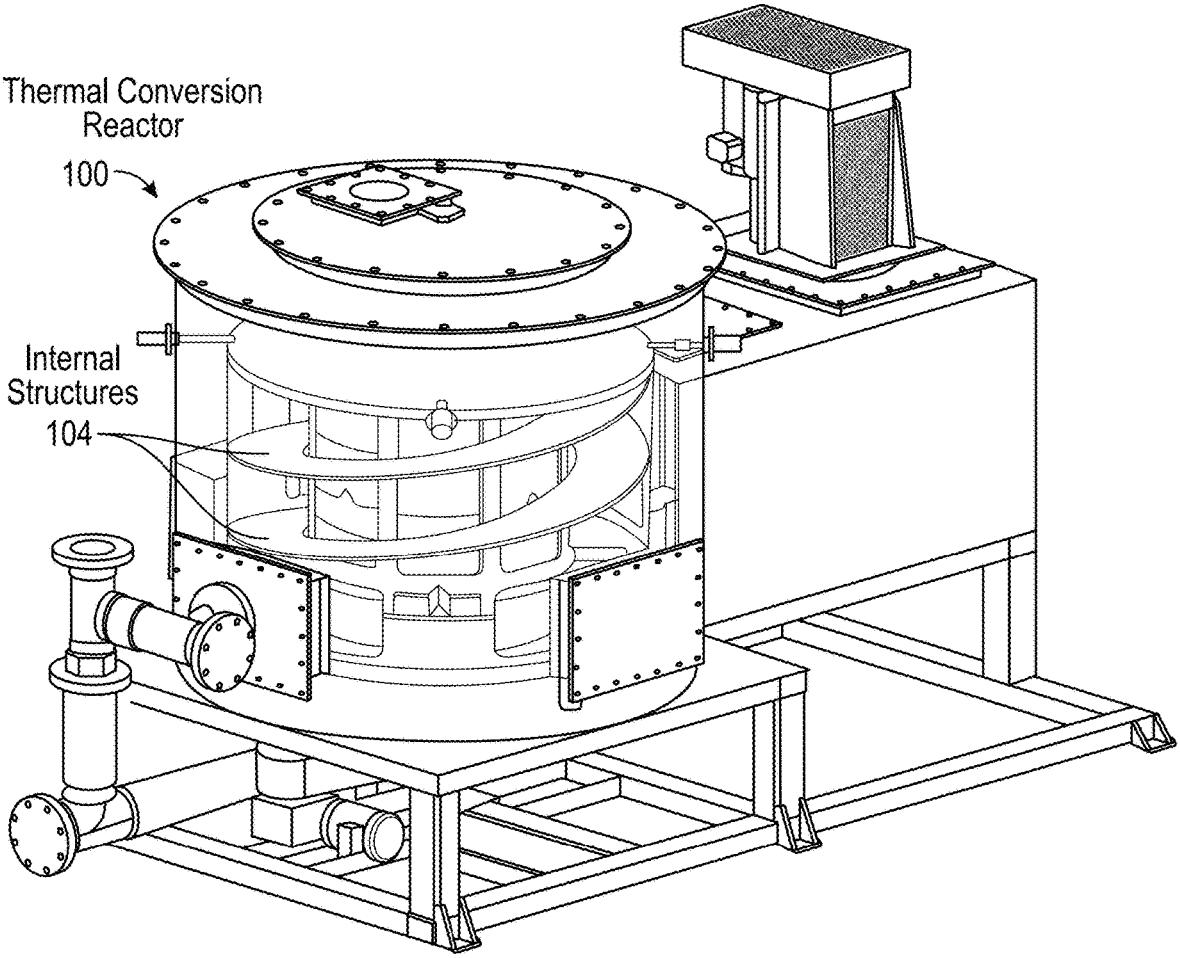
Figure 3:
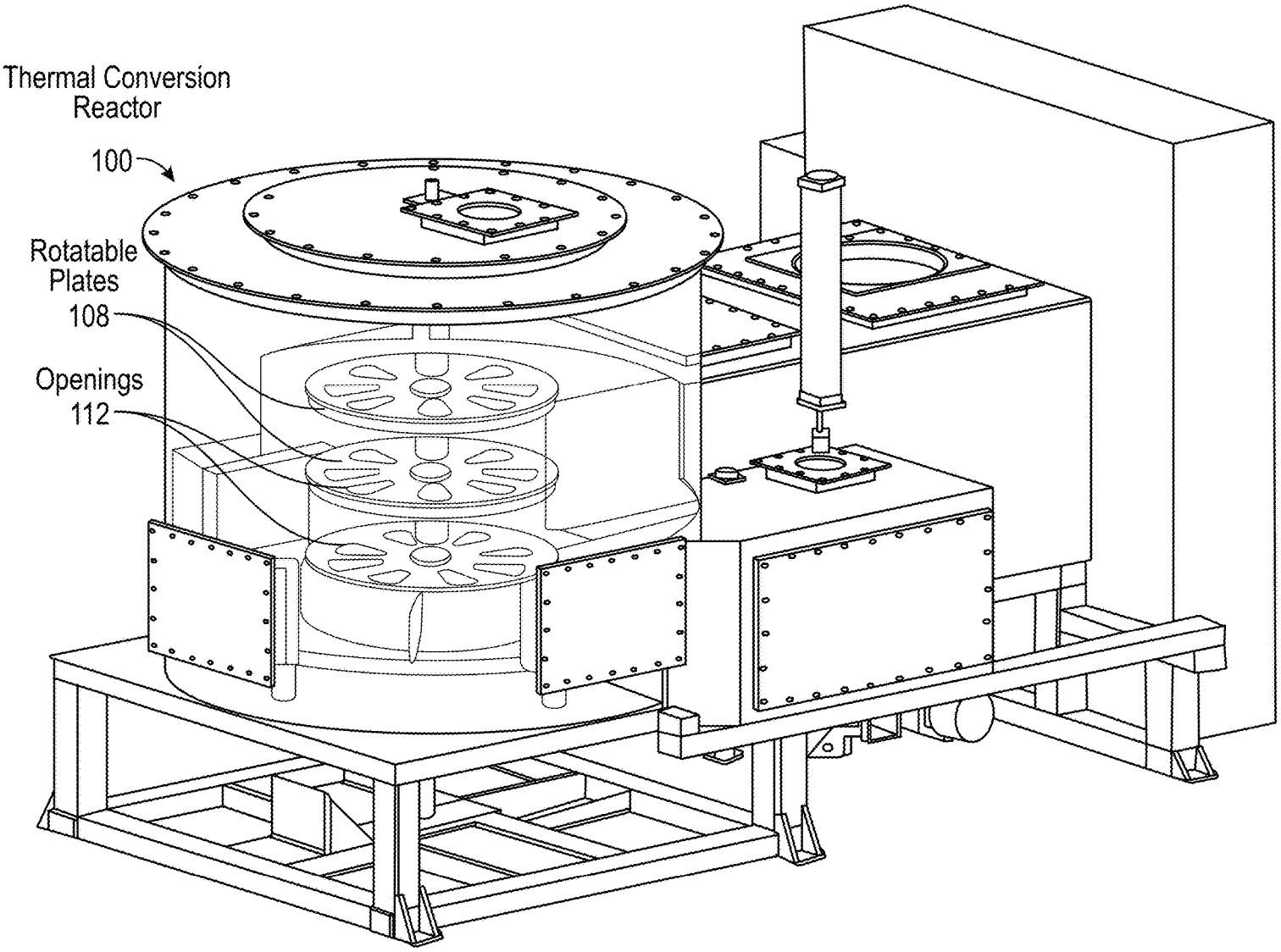

With further reference to the figures, FIGS. 1-3 illustrates an exemplary embodiment of a thermal conversion reactor 100 embodying one or more aspects of the present disclosure. As disclosed herein, the thermal conversion reactor 100 is usable in a system (e.g., system 182 (FIGS. 11-16), etc.) for thermally converting landfill-bound plastic waste (broadly, polymeric material) into process gas (e.g., syngas, etc.), for use as a fuel by a generator (e.g., microturbine genset, other genset or generator, etc.) for the generation of electrical power according to exemplary embodiments of the present disclosure.

In exemplary embodiments, the thermal conversion reactor 100 may comprise a gas gasifier (e.g., downdraft gasifier, hybrid updraft/downdraft gasifier, etc.). In such embodiments, the thermal conversion reactor 100 is operable for thermally converting under gasification technology landfill-bound plastic waste into process gas, which may be subsequently conditioned for use as a fuel by a generator for the generation of electrical power.

As shown in FIG. 2, the reactor chamber of the thermal conversion reactor 100 is configured to include internal structures 104 (e.g., baffles, racetracks, raceways, spiral guide vanes, etc.) positioned between the inner and outer reactor walls. In this illustrated embodiment, the internal structures 104 comprise baffles, racetracks, raceways, or spiral guide vanes that are configured to direct the reaction gas to rotate around the inner reactor wall and enter the inner reactor chamber well mixed and evenly distributed concentrically. The improved mixing and concentric distribution improves reactivity inside the reaction chamber of the thermal conversion reactor 100.

In exemplary embodiments, the internal structures 104 comprise material(s) (e.g., steel, other metal, etc.) that are able to withstand temperatures up to at least about 1000, 1100, or 1200 degrees Celsius (or other high temperatures) within the thermal conversion reactor 100. In exemplary embodiments, the internal structures 104 comprise dual spiraling internal structures configured to cause the gas to circulate in a double vortex manner within the reaction chamber, e.g., to homogenize the gas before discharge from the reaction chamber, etc.

Figure 7:
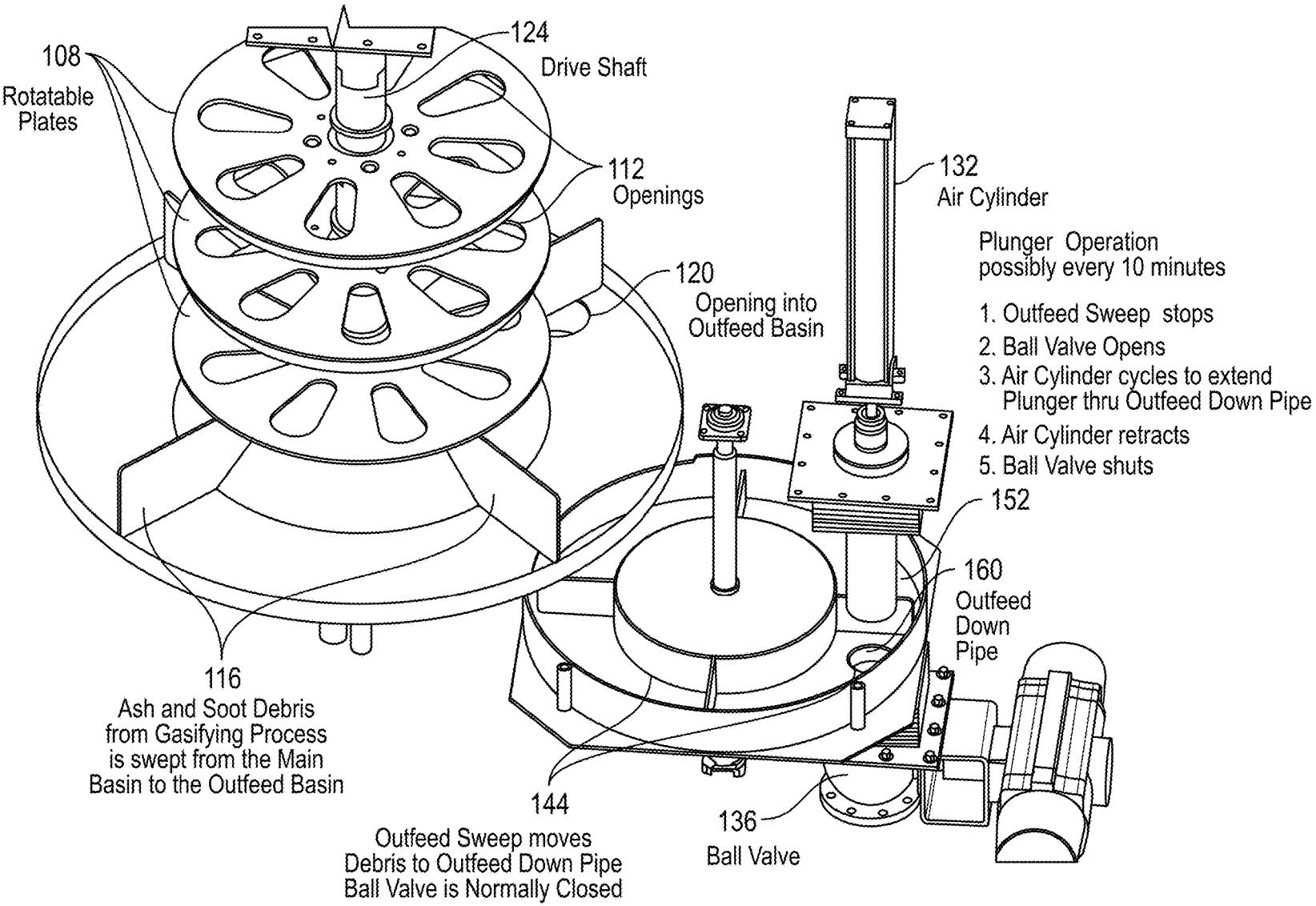
FIG. 7 is a perspective view illustrating the rotatable plates and sweeps within the thermal conversion reactor shown in FIG. 3 and the outfeed sweeps and plunger attached to the air cylinder shown in FIG. 5.

As shown in FIGS. 3 and 7, the thermal conversion reactor 100 includes rotatable reactor plates 108 within the reaction chamber of the thermal conversion reactor 100. The reactor plates 108 include openings 112 (e.g., perforations, etc.). The reactor plates 108 are configured to rotate axially in the reactor chamber such that the reactor plates 108 convey feedstock (e.g., gravity fed through the openings in the reactor plates, etc.) through the thermal conversion reactor 100. The reactor plates 108 are configured to provide additional surface area for heat transfer to the feedstock material, improve reaction efficiency, and convey non-reacting byproduct to the appropriate outfeed.

The thermal conversion reactor 100 also includes rotatable sweeps 116 (FIG. 7) along a bottom of the thermal conversion reactor 100. The rotatable sweeps 116 are operable for sweeping (broadly, conveying) ash and soot debris (broadly, non-reacting byproduct or debris) from the main basin of the thermal conversation reactor 100 into an opening 120 for discharge (broadly, conveyance) into the outfeed basin.

In exemplary embodiments, the reactor plates 108 and sweeps 116 comprise material (s) (e.g., steel, other metal, etc.) that are able to withstand temperatures up to at least about 1000, 1100, or 1200 degrees Celsius (or other high temperatures) within the thermal conversion reactor 100.

In the illustrated embodiment shown in FIGS. 3 and 7, the thermal conversion reactor 100 includes three rotatable reactor plates 108 each with multiple elongate generally oval shaped openings 112. The reactor plates 108 and the sweeps 116 may be coupled to the same drive shaft 124 (FIG. 7) for common rotation at the same rotational speed. The openings in the top or first reactor plate may be vertically misaligned with or offset from the openings in the middle or second plate. The openings in the middle or second plate may be vertically misaligned with or offset from the openings in the bottom or third plate.

The vertical misalignment or offset of the openings 112 in the reactor plates 108 may help to slow down the passage or conveyance of the feedstock through the reactor 100. And the reactor plates 108 also provide additional surface area for heat transfer to the feedstock material when the feedstock falls through the openings 112 of one reactor plate 108 onto the reactor plate 108 therebelow. The longer dwell time within the reactor 100 due to the reactor plates 108 may help with having non-reacting byproduct waste that is primarily ash instead of crude oil globs. In turn, this may advantageously allow for longer time intervals between shutdowns for byproduct cleanup and/or eliminate the need for crude oil filter(s) when the non-reacting byproduct is substantially entirely ash with little to no crude oil byproduct. Although FIGS. 3 and 7 illustrate three reactor plates 108 having multiple elongate oval shaped openings 112, other exemplary embodiments may be configured differently, e.g., with more or less than three reactor plates, with more or less openings in the reactor plates, with differently shaped openings in the reactor plates, with one or more reactor plates that rotate at a different rotational speed than another reactor plate(s), etc.

Figure 4:
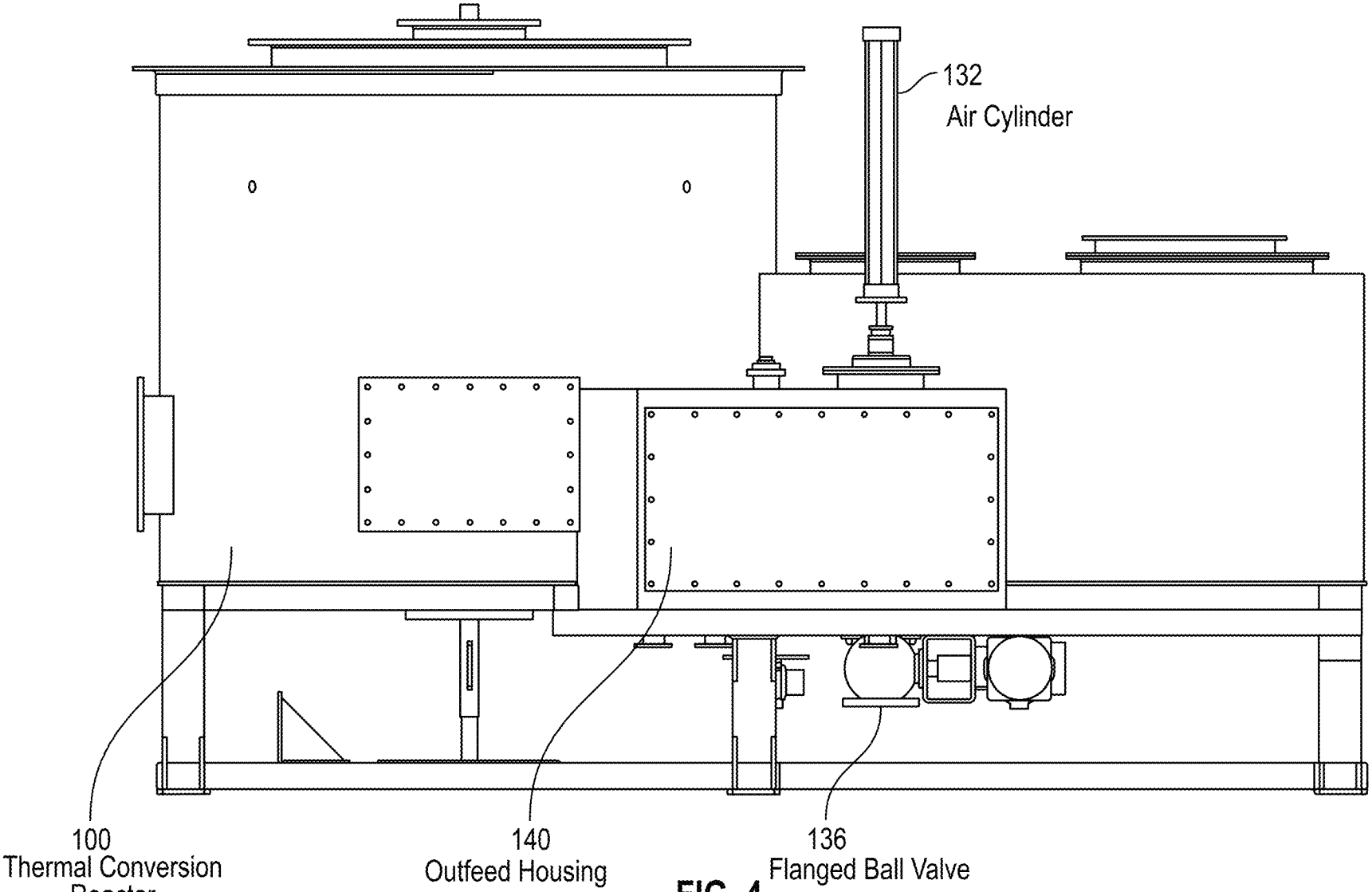
FIG. 4 is a side view of the thermal conversion reactor shown in FIGS. 1-3 and also illustrating the air cylinder, flanged ball valve, and outfeed housing of the outfeed conveyance.
Figure 5:
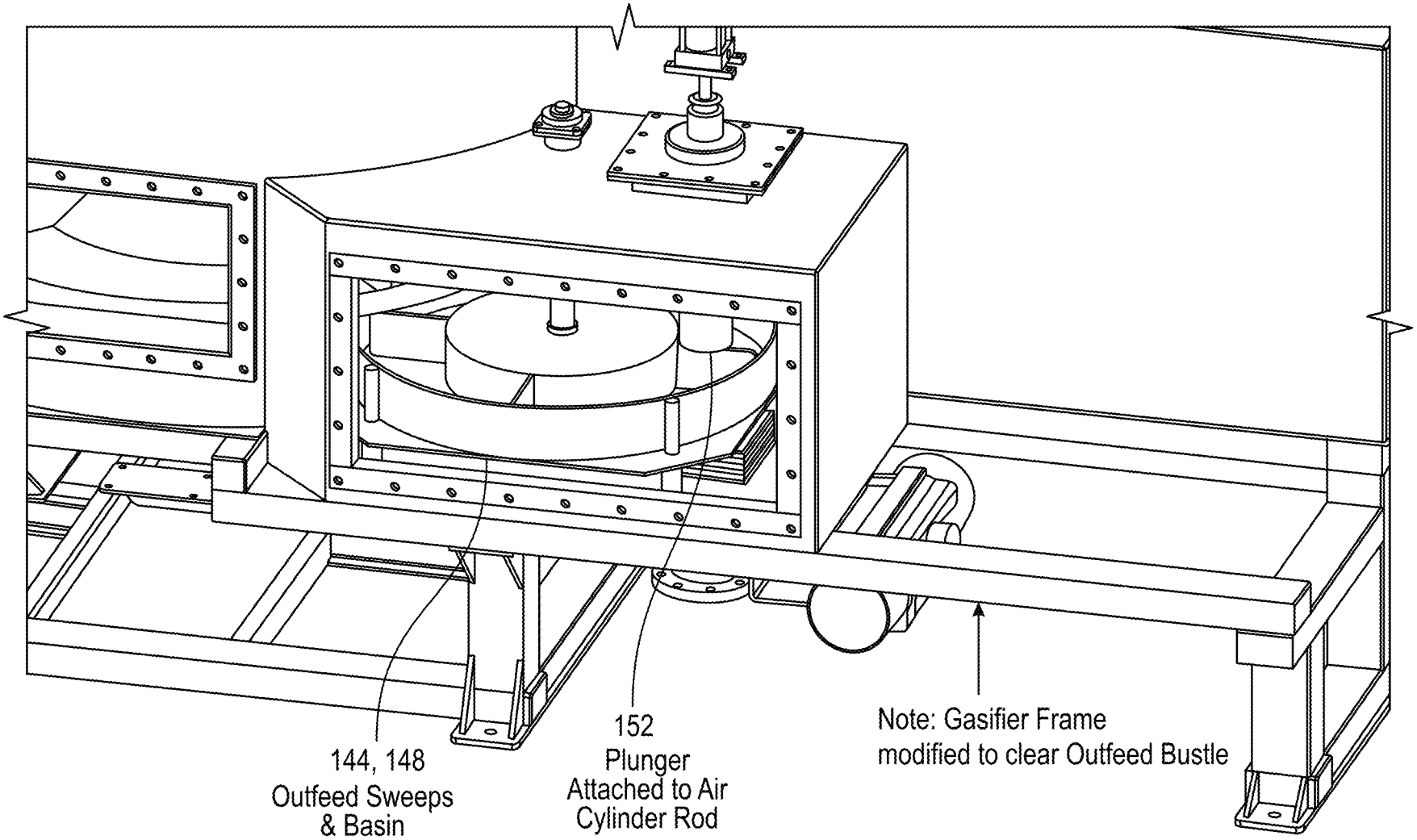
FIG. 5 is a perspective view illustrating outfeed sweeps and basin and a plunger attached to the air cylinder rod that are within the interior of the outfeed housing shown in FIG. 4.
Figure 6:
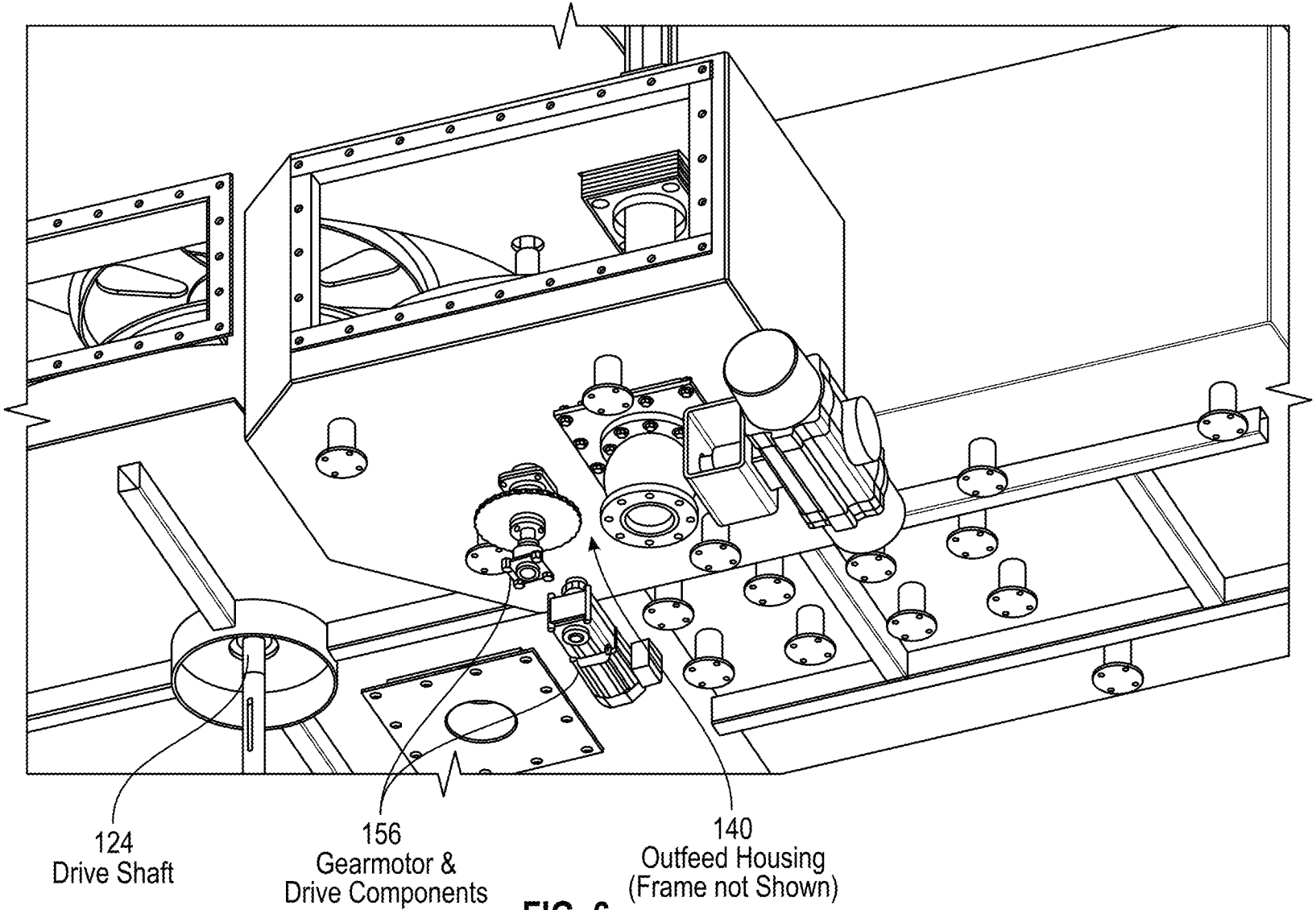
FIG. 6 is a lower perspective illustrating a gearmotor and drive components for the outfeed sweeps shown in FIG. 5.

Features of the thermal conversion reactor 100 and outfeed conveyance 128 are also shown in FIGS. 4-7. For example, FIG. 4 illustrates an air cylinder 132, flanged ball valve 136, and an outfeed housing 140 of the outfeed conveyance 128. FIG. 5 illustrates an interior of the outfeed housing 140 including outfeed sweeps 144, basin 148, and plunger 152 attached to the rod of the air cylinder 132. FIG. 6 illustrates a gearmotor and drive components 156 for the outfeed sweeps 144. FIG. 7 illustrates the rotatable plates 108 and sweeps 116 within the thermal conversion reactor 100. FIG. 7 also illustrates the outfeed sweeps 144 and plunger 152 attached to the air cylinder 132.

With continued reference to FIG. 7, the sweeps 116 within the thermal conversion reactor 100 are rotatable for sweeping (broadly, conveying) ash and soot debris (broadly, non-reacting byproduct or debris) from the main basin of thermal conversation reactor 100 into an opening 120 for discharge into the outfeed basin 148. The outfeed sweeps 144 are rotatable for sweeping the ash and soot debris from the outfeed basin 148 to an outfeed down pipe 160 (broadly, a discharge opening) that is normally closed by the ball valve 136.

When the outfeed sweeps 144 stop rotating, the ball valve 136 opens. The air cylinder 132 cycles to extend the plunger 152 through the outfeed down pipe 160 and force ash and soot debris through the outfeed down pipe 160. The air cylinder 152 retracts and the ball valve 136 closes and shuts the outfeed down pipe 160. The ash or soot debris is discharged from the outfeed down pipe 160 onto a disposal auger, conveyor belt (e.g., FIGS. 11-14, etc.) or other means of conveyance from the outfeed to waste collection 164 (e.g., FIG. 14, etc.). By way of example, the plunger operation may occur every ten minutes. Alternatively the plunger operation may be configured to cycle at a time period less than ten minutes or greater than ten minutes in other exemplary embodiments.

Other exemplary embodiments may include means to automatically reinject in complexly reacted waste product back into the reaction chamber of the thermal conversion reactor for a more complete reaction to increase yield.

Figure 8:
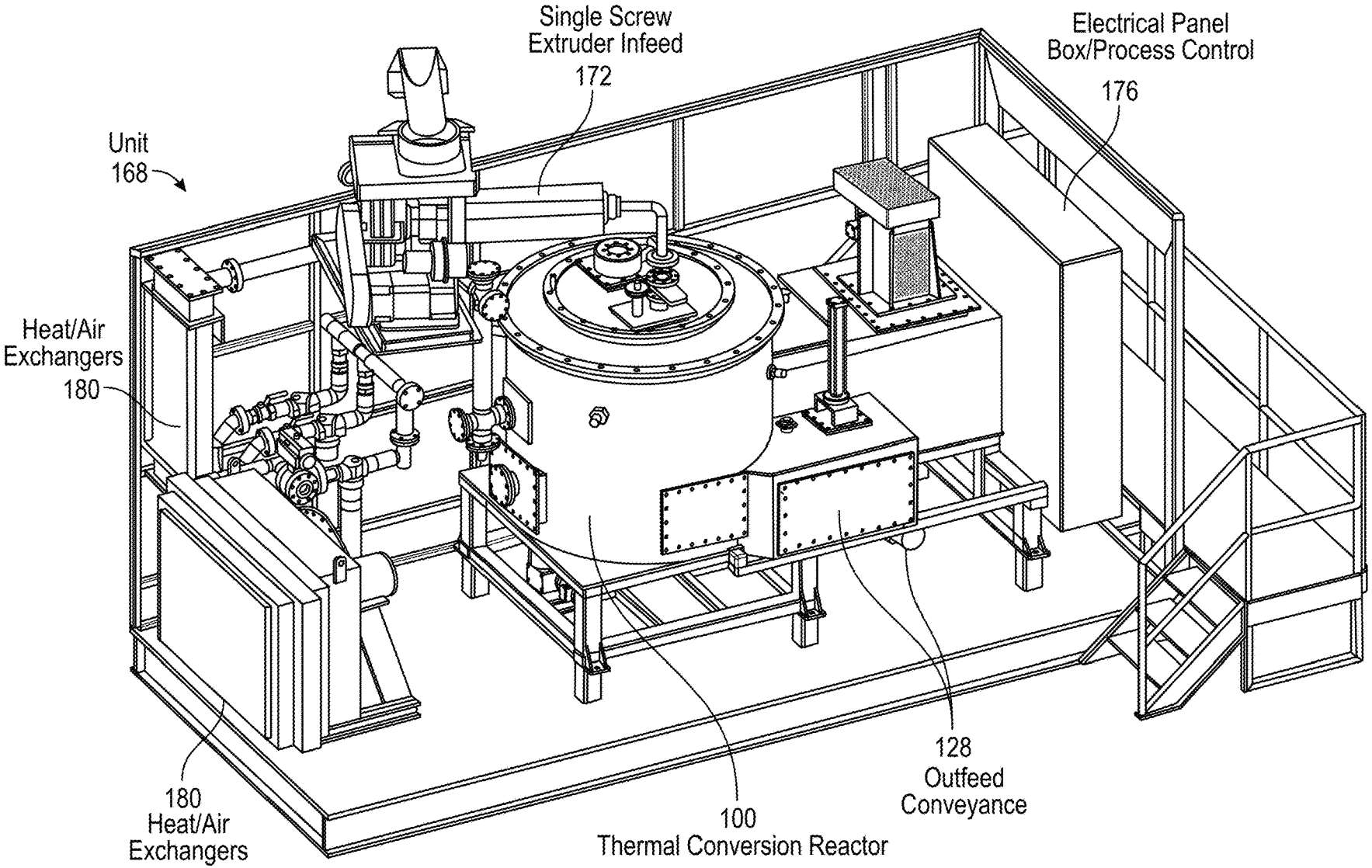
FIG. 8 is a perspective view of an exemplary embodiment of a unit or assembly including the thermal conversion reactor and outfeed conveyance shown in FIGS. 1-7 and additional components, such as a single screw extruder infeed, electrical panel box/process control, and multiple heat/air exchangers.
Figure 9:
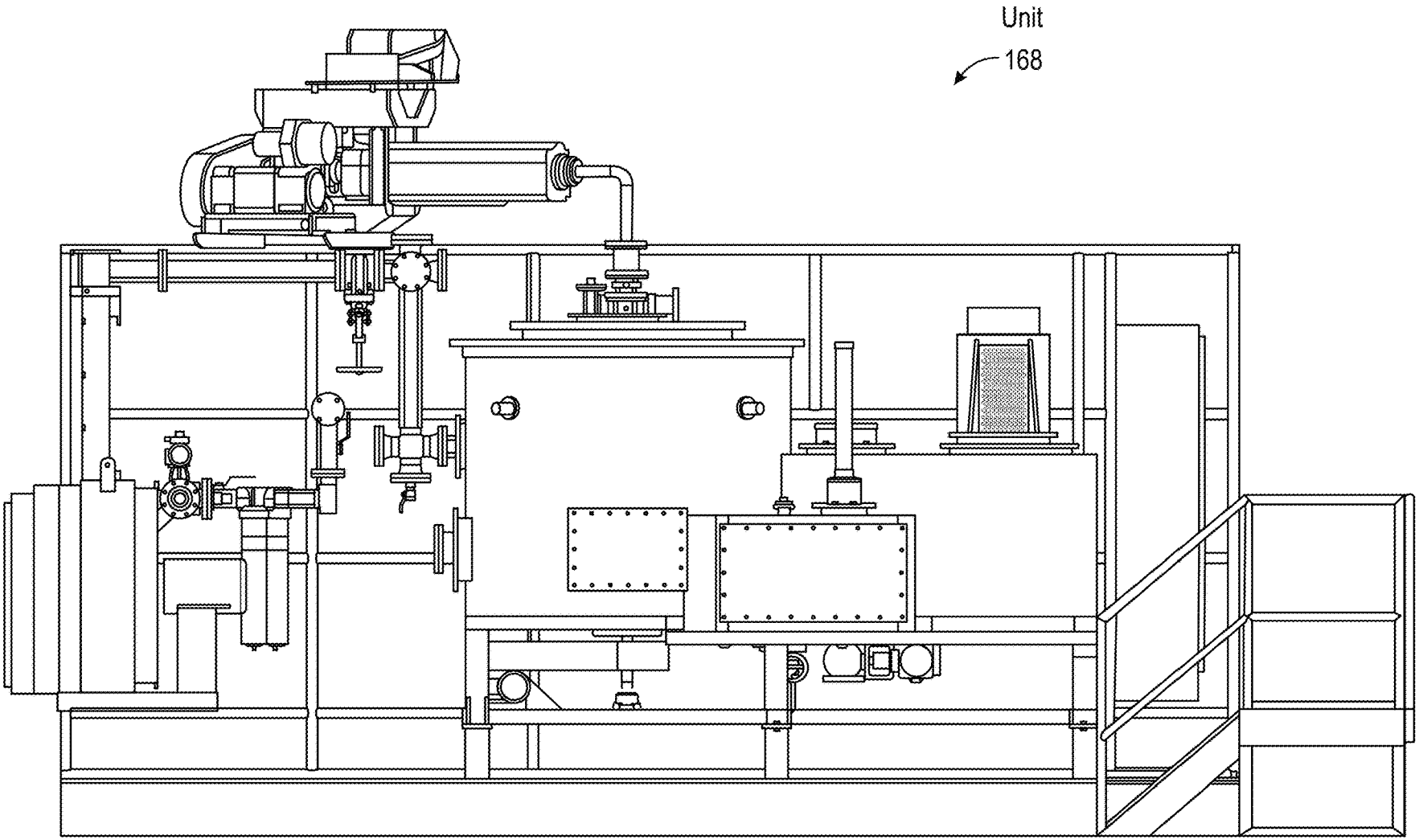
FIG. 9 is a side view of the unit shown in FIG. 8.
Figure 10:
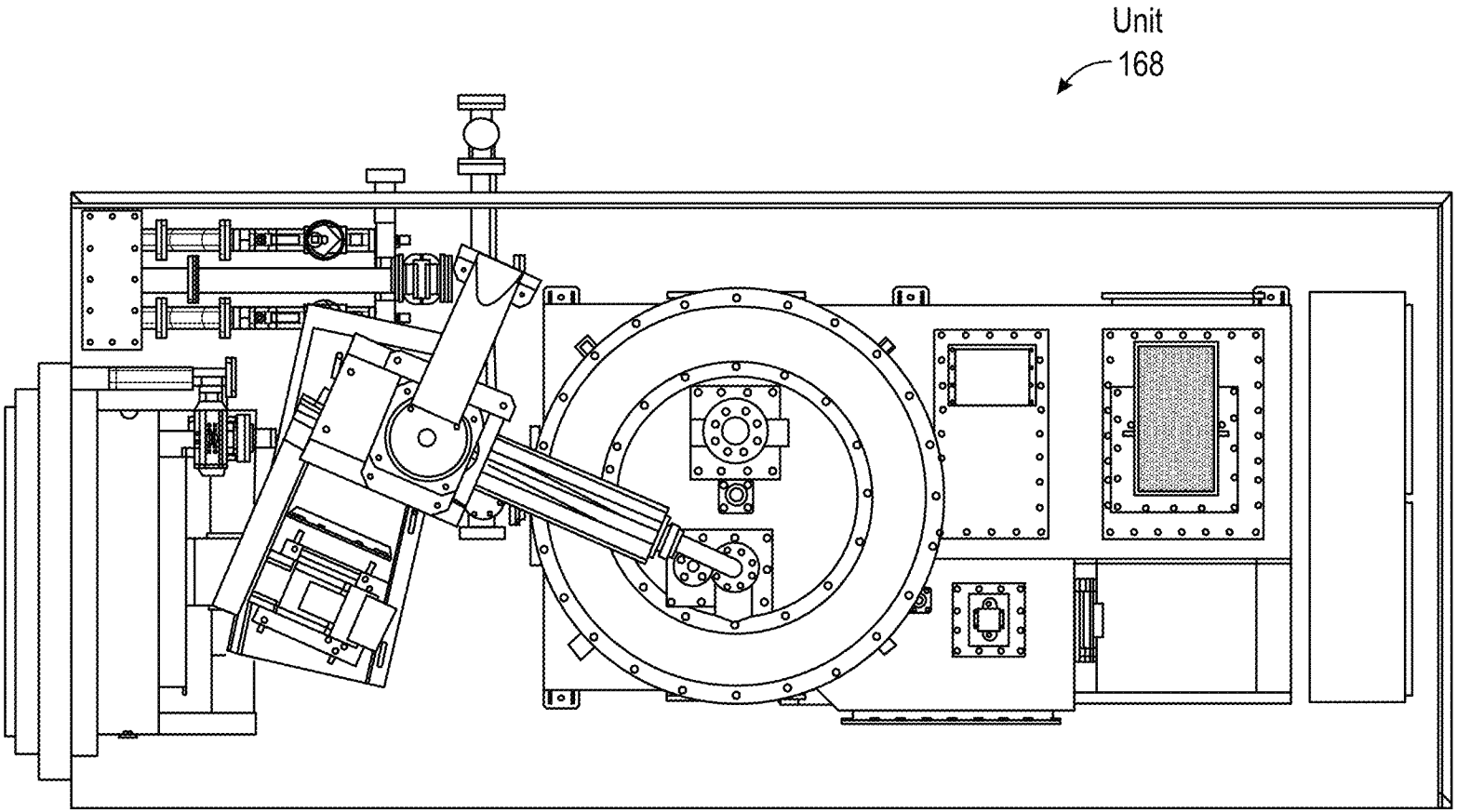
FIG. 10 is a top view of the unit shown in FIG. 8.

FIGS. 8-10 illustrate an exemplary embodiment of a unit or assembly 168 including the thermal conversion reactor 100 and outfeed conveyance 128 shown in FIGS. 1-7. The unit 168 also includes the following additional components within an enclosure: a single screw extruder infeed 172, electrical panel box/process control 176, and multiple heat/air exchangers 180.

The single screw extruder infeed 172 may be configured to be operable for receiving waste in solid form and extruding the waste (e.g., after heating to 400 degrees Celsius, etc.) to the thermal conversion reactor 100. The single screw extruder infeed 172 may include an infeed section usable for improved oil cleanout.

Heat/air exchangers 180 may be downstream of the thermal conversion reactor 100. The heat/air exchangers 180 may allow for condensing out incompletely reacted liquid molecules that is pumped via displacement pump to infeed.

The electrical panel box/process control station 176 for the unit 168 is located in a separate attached compartment adjacent the unit 168. The thermal conversion reactor 100 may be controllable using a variety of sensors, Programmable Logic Controllers (PLCs), and control algorithms. Process conditions may be communicated and adjusted using a Human-Machine Interface (HMI). In an exemplary embodiment, a menu on a display of a controller or control panel may be provided that includes various user inputs that may be entered or selected for customization of different operational parameters or variables for the thermal conversion process (e.g., depending on the particular type of bulk material or waste being thermally converted, cooler configuration, turbine generator configuration, and/or other factors, etc.). By way of example, the controller may be configured to be operable for controlling the thermal conversion and for monitoring and controlling operational parameters within the thermal conversion reactor 100, such as dwell time, amount of air and steam injected into the reactor, temperature, pressure, rotating speed of the reactor plates, type of plastic, composition of plastic feedstock, feed rate of feedstock, etc. Controlling these operational parameters (e.g., via a PLC control panel, etc.) allows the process gas (e.g., syngas, etc.) to properly be produced and meet the acceptable levels needed to run a generator (e.g., microturbine genset, other genset or generator, etc.) for the generation of electrical power according to exemplary embodiments of the present disclosure. Process parameters downstream of the thermal conversion reactor 100 may also be monitored, such as pressure after compressor, how much buffer space available, whether to slow or speed up the process (e.g., via a control loop algorithm, etc.).

By way of example only, the exemplary embodiment of the unit 168 shown in FIGS. 8-10 is dimensionally sized to have a total footprint of 40 feet in length, 10 feet in width, and 15 feet in height. These specific dimensions are example in nature and do not limit the scope of the present disclosure. In alternative embodiments, the unit may be configured to have a different footprint, differently, e.g., longer or shorter, wider or narrower, taller or shorter, etc.

In exemplary embodiments, the unit 168 shown in FIGS. 8-10 is enclosed with access doors, panels, and safety provisions. An electrical panel box for controlling the unit is provided in a separately encased end attachment to the unit 168 meeting all safety code requirements.

FIGS. 11-16 illustrate an exemplary embodiment of a system 182 operable for the thermal conversion of landfill-bound plastic waste (broadly, polymeric material) into electrical energy. As shown, the system 182 includes the unit 168 shown in FIGS. 8-10 including the thermal conversion reactor 100 and outfeed conveyance 128 shown in FIGS. 1-7, and additional system components, such as an infeed hopper 184, flare 186, scrubber 188, compressed gas storage tank 190, microturbine genset 192, compressor 194, and coalescers/filter separators 196.

The coalescers/filter separators 196 may be configured to be operable for filtering crude oil byproduct from the process gas. Scrubber(s) 188 may be used for further purifying the process gas to remove water. The flare 186 may be configured to be operable for controlling flare out and smoke during startup or shutdown. The flare 186 may be connected to the thermal conversion reactor 100 thereby allowing the thermal conversion reactor 100 to discharge to the flare 186. The flare 186 may be operable for reducing flame and emissions. Alternatively, the system 182 may include an enclosed combustor instead of or in addition to the flare 186.

In exemplary embodiments, the system 182 may further include an exhaust (e.g., chimney, etc.) and a plastic shredder. The plastic shredder may be operable for shredding and then feeding shredded plastic into the infeed hopper 184.

The following is a process overview of an exemplary method for thermally converting landfill-bound plastic waste (broadly, polymeric materials) into electrical energy.

1. Shredded landfill-bound plastic is dropped into a hopper.
2. Plastic is fed from the hopper to a single screw extruder through an auger.
3. The single screw extruder melts plastic in a continuous process.
4. Melted plastic is fed into thermal conversion reactor.
5. The thermal conversion reactor further heats the melted plastic, converting it into an energy-rich process gas.

6. Non-reactive byproduct (e.g., ash, soot debris, solids, etc.) exits the thermal conversion reactor through an outfeed conveyor.
7. Process gas exits the thermal conversion reactor and is directed to heat/air exchangers, where process gas is cooled in preparation of further conditioning.
8. Process gas is then directed to a scrubber to provide process buffer capacity and to separate liquid and solid particulate matter.
9. Process gas is then directed through coalescing/filter separators, to further separate solids and liquids from gas.
10. Process gas is then compressed and directed into a tank for storage, from where it is fed into a microturbine genset to produce electricity.
11. The flare is used as a safety measure to dispose of any excess or unused process gas produced in this process.
12. The reactor and conditioning system is controlled using a variety of sensors, Programmable Logic Controllers (PLCs), and control algorithms.
13. Process conditions are communicated and adjusted using a Human-Machine Interface (HMI).

Example embodiments disclosed herein may be used with a wide range of waste materials including landfill-bound plastic, reclaimed "clean" plastic, polyethylene terephthalate (PET), high-density polyethylene (HDPE), polyvinyl chloride (PVC), low-density polyethylene (LDPE), polypropylene (PP), polystyrene (PS), combinations thereof, other plastics, other polymeric materials, etc.), other carbon-based feedstock etc. Accordingly, aspects of the present disclosure should not be limited to use with only landfill-bond plastic or with any single type of waste material or feedstock.

Accordingly, disclosed herein are exemplary embodiments of thermal conversion reactors usable in systems for thermally converting landfill-bound plastic waste into electrical energy. Also disclosed are exemplary embodiments of systems for thermally converting landfill-bound plastic waste into electrical energy. Further, exemplary embodiments are disclosed of controllers configured to be operable for allowing various user inputs to be entered and/or selected for customization of different operational parameters for a process of thermally converting landfill-bound plastic waste into electrical energy. Additionally, exemplary methods are disclosed for thermally converting landfill-bound plastic waste into electrical energy.

In exemplary embodiments, a thermal conversion reactor comprises one or more internal structures between inner and outer reactor walls of the thermal conversion reactor. The one or more internal structures are configured for directing feedstock and process gas to rotate in a circulating vortex within a reaction chamber of the thermal conversion reactor. Additionally, or alternatively, the thermal conversion reactor comprises one or more plates including one or more openings therein. The one or more plates are axially rotatable within the reaction chamber of the thermal conversion reactor for conveying feedstock through the thermal conversion reactor.

In exemplary embodiments, the one or more internal structures comprise dual spiraling internal structures between the inner and outer reactor walls. The dual spiraling internal structures are configured to cause the process gas to circulate in a double vortex manner within the reaction chamber.

In exemplary embodiments, the one or more internal structures comprise one or more baffles, racetracks, raceways, or spiral guide vanes that are configured to direct the process gas to rotate around the inner reactor wall.

In exemplary embodiments, the one or more internal structures comprise steel or other material(s) capable of withstanding high temperatures within the thermal conversion reactor; and/or the one or more plates comprise steel or other material(s) capable of withstanding high temperatures within the thermal conversion reactor.

In exemplary embodiments, the one or more plates comprise at least three plates each including multiple openings therethrough.

In exemplary embodiments, the one or more plates comprise: a top or first plate including first openings therethrough, a middle or second plate including second openings therethrough, and a bottom or third plate including third openings therethrough. The second openings of the second plate are vertically misaligned with or offset from the first openings of the first plate. The third openings of the third plate are vertically misaligned with or offset from the second openings of the second plate.

In exemplary embodiments, the one or more plates comprise multiple plates each including multiple openings therethrough and configured for conveying feedstock through the thermal conversion reactor via the feedstock falling through and/or being gravity fed through the multiple openings in the multiple plates as the multiple plates are axially rotated within the reaction chamber of the thermal conversion reactor.

In exemplary embodiments, the one or more plates comprise multiple plates coupled to a same drive shaft for common rotation at a same rotational speed.

In exemplary embodiments, the thermal conversion reactor includes one or more rotatable sweeps configured to be operable for sweeping debris from the thermal conversation reactor into an opening for discharge from the thermal conversion reactor. The one or more plates and the one or more rotatable sweeps may be coupled to a same drive shaft for common rotation at a same rotational speed. The one or more plates and the one or more rotatable sweeps may comprise steel or other material(s) capable of withstanding high temperatures within the thermal conversion reactor.

In exemplary embodiments, a system comprises a thermal conversion reactor as disclosed herein. The system also includes an outfeed conveyance configured for receiving debris discharged from the thermal conversion reactor. The outfeed conveyance may include one or more rotatable sweeps configured to be operable for sweeping debris from an outfeed basin into an outfeed opening for discharge from the outfeed basin. The outfeed conveyance may further include a plunger configured to be operable for extending into the outfeed opening to thereby forcibly discharge debris out of the opening for conveyance to waste collection.

In exemplary embodiments, the system further include a single screw extruder infeed configured to be operable for receiving waste and extruding the waste to the thermal conversion reactor; one or more heat/air exchangers downstream of the thermal conversion reactor and configured to be operable for condensing incompletely reacted liquid molecules and/or for cooling process gas in preparation of further conditioning; and a controller configured to be operable for allowing various user inputs to be entered and/or selected for customization of different operational parameters of the thermal conversion reactor. The controller may be configured to be operable for monitoring and controlling the different operational parameters within the thermal conversion reactor, including one or more of dwell time, amount of air and steam injected, temperature, pressure, and rotating speed of the one or more plates within the thermal conversion reactor.

In exemplary embodiments of the system, an infeed hopper is configured to be operable for feeding waste to the single screw extruder infeed. A flare is coupled with the thermal conversion reactor thereby allowing the thermal conversion reactor to discharge to the flare, the flare configured to be operable for reducing flame and emissions. A scrubber is configured to be operable for further purifying process gas to remove water, providing process buffer capacity, and/or for separating liquid and solid particulate matter. One or more coalescers/filter separators are configured to be operable for filtering crude oil byproduct from process gas and/or for further separating solids and liquids from process gas. A compressor is configured to be operable for compressing process gas. A compressed gas storage tank is configured for receiving and storing compressed process gas from the compressor. A microturbine genset is configured for receiving process gas from the compressed gas storage tank for producing electricity.

In exemplary embodiments, a system for thermally converting landfill-bound plastic waste into electrical energy comprises a thermal conversion reactor as disclosed herein and a controller. The controller is configured to be operable for allowing various user inputs to be entered and/or selected for customization of different operational parameters of the system when used for thermally converting landfill-bound plastic waste into electrical energy. The controller may be configured to be operable for monitoring and controlling the different operational parameters within the thermal conversion reactor, including one or more of dwell time, amount of air and steam injected, temperature, pressure, and rotating speed of the one or more plates within the thermal conversion reactor. The system may further include a generator. And the controller may be configured to be operable for controlling the different operational parameters within the thermal conversion reactor to thereby allow process gas to properly be produced by the thermal conversion reactor that meets acceptable levels needed to run the generator for the generation of electrical power.

In exemplary embodiments, the thermal conversion reactor comprises a gasifier configured to be operable for thermally converting landfill-bound plastic waste into process gas, which is subsequently conditionable for use as a fuel by a generator for the generation of electrical power.

In exemplary embodiments, the thermal conversion reactor is configured to be usable in a system for thermally converting landfill-bound plastic waste into process gas for use as a fuel by a generator for the generation of electrical energy.

Exemplary embodiments include a controller for a thermal conversion reactor usable in a system for thermally converting landfill-bound plastic waste into process gas for use as a fuel by a generator for the generation of electrical energy. The controller is configured to be operable for allowing various user inputs to be entered and/or selected for customization of different operational parameters for the thermal conversion reactor when the thermal conversion reactor is being used within a system for thermally converting landfill-bound plastic waste into electrical energy. The controller is configured to be operable for monitoring and controlling the different operational parameters within the thermal conversion reactor, including one or more of dwell time, amount of air and steam injected, temperature, pressure, and rotating speed of one or more rotatable plates within the thermal conversion reactor.

In exemplary embodiments, the controller is configured to be operable for controlling the different operational parameters within the thermal conversion reactor to thereby allow process gas to properly be produced by the thermal conversion reactor that meets acceptable levels needed to run a generator for the generation of electrical power.

In exemplary embodiments, a system for thermally converting landfill-bound plastic waste into electrical energy comprises the controller and a thermal conversion reactor. The thermal conversion reactor includes one or more internal structures between inner and outer reactor walls of the thermal conversion reactor. The one or more internal structures are configured for directing feedstock and process gas to rotate in a circulating vortex within a reaction chamber of the thermal conversion reactor. The thermal conversion reactor further includes one or more plates including one or more openings therein. The one or more plates are axially rotatable within the reaction chamber of the thermal conversion reactor for conveying feedstock through the thermal conversion reactor.

In exemplary embodiments, the thermal conversion reactor is usable in a system for thermally converting landfill-bound plastic waste into process gas for use as a fuel by a generator for the generation of electrical energy. The thermal conversion reactor comprises one or more internal structures between inner and outer reactor walls of the thermal conversion reactor. The one or more internal structures are configured for directing feedstock and process gas to rotate in a circulating vortex within a reaction chamber of the thermal conversion reactor. The thermal conversion reactor further comprises one or more plates including one or more openings therein. The one or more plates are axially rotatable within the reaction chamber of the thermal conversion reactor for conveying feedstock through the thermal conversion reactor.

In exemplary embodiments, the one or more internal structures comprise spiraling internal structures between the inner and outer reactor walls. The spiraling internal structures are configured to cause the process gas to circulate in a double vortex manner within the reaction chamber. The one or more plates comprise multiple plates each including multiple openings therethrough and configured for conveying feedstock through the thermal conversion reactor via the feedstock falling through and/or being gravity fed through the multiple openings in the multiple plates as the multiple plates are axially rotated within the reaction chamber of the thermal conversion reactor.

In exemplary embodiments, the one or more internal structures comprise steel or other material(s) capable of withstanding high temperatures within the thermal conversion reactor. And the one or more plates comprise steel or other material(s) capable of withstanding high temperatures within the thermal conversion reactor.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances. Or for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about", equivalents to the quantities are included.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A thermal conversion reactor comprising:

one or more internal structures between inner and outer reactor walls of the thermal conversion reactor, the one or more internal structures configured for directing feedstock and process gas to rotate in a circulating vortex within a reaction chamber of the thermal conversion reactor;

a plurality of plates, each including one or more openings therethrough, and axially rotatable about a vertical axis within the reaction chamber of the thermal conversion reactor for conveying the feedstock downwardly through the thermal conversion reactor via the one or more openings of the plates, wherein openings of adjacent plates are vertically misaligned or offset;

one or more rotatable sweeps configured to be operable for sweeping debris from the thermal conversation reactor into an opening for discharge from the thermal conversion reactor, the plurality of plates and the one or more rotatable sweeps coupled to a same drive shaft for common rotation about the vertical axis at a same rotational speed; and an outfeed conveyance configured for receiving debris discharged from the thermal conversion reactor, wherein the outfeed conveyance includes:

one or more rotatable sweeps configured to be operable for sweeping debris from an outfeed basin into an outfeed opening for discharge from the outfeed basin; and a plunder configured to be operable for extending into the outfeed opening to thereby forcibly discharge debris out of the opening for conveyance to waste collection.

2. The thermal conversion reactor of claim 1, wherein the one or more internal structures comprise dual spiraling internal structures between the inner and outer reactor walls and configured to cause the process gas to circulate in a double vortex manner within the reaction chamber.

3. The thermal conversion reactor of claim 1, wherein the one or more internal structures comprise one or more racetracks, raceways, or spiral guide vanes that are configured to direct the process gas to rotate around the inner reactor wall.

4. The thermal conversion reactor of claim 1, wherein:

the one or more internal structures comprise steel or other material(s) capable of withstanding high temperatures up to at least 1000 degrees Celsius within the thermal conversion reactor; and/or the plates comprise steel or other material(s) capable of withstanding high temperatures up to at least 1000 degrees Celsius within the thermal conversion reactor.

5. The thermal conversion reactor of claim 1, wherein the plates comprise at least three plates each including multiple openings therethrough and configured for conveying the feedstock downwardly through the thermal conversion reactor via the feedstock falling downwardly through and/or being gravity fed through the multiple openings in the at least three plates as the at least three plates are axially rotated about the vertical axis within the reaction chamber of the thermal conversion reactor.

6. The thermal conversion reactor of claim 1, wherein the plates comprise:

a top or first plate including first openings therethrough;

a middle or second plate including second openings therethrough, the second openings vertically misaligned with or offset from the first openings; and a bottom or third plate including third openings therethrough, the third openings vertically misaligned with or offset from the second openings.

7. The thermal conversion reactor of claim 1, wherein the plates comprise multiple plates each including multiple openings extending downwardly therethrough and configured for conveying the feedstock downwardly through the thermal conversion reactor via the feedstock falling downwardly through and/or being gravity fed through the multiple openings in the multiple plates as the multiple plates are axially rotated about the vertical axis within the reaction chamber of the thermal conversion reactor.

8. The thermal conversion reactor of claim 1, wherein the plates and the one or more rotatable sweeps comprise steel or other material(s) capable of withstanding high temperatures up to at least 1000 degrees Celsius within the thermal conversion reactor.

9. A system comprising the thermal conversion reactor of claim 1, wherein the system further includes:

a single screw extruder infeed configured to be operable for receiving waste and extruding the waste to the thermal conversion reactor;

one or more heat/air exchangers downstream of the thermal conversion reactor and configured to be operable for condensing incompletely reacted liquid molecules and/or for cooling the process gas in preparation of further conditioning; and a controller configured to be operable for allowing various user inputs to be entered and/or selected for customization of different operational parameters of the thermal conversion reactor.

10. The system of claim 9, wherein the controller is configured to be operable for monitoring and controlling the different operational parameters within the thermal conversion reactor, including one or more of dwell time, amount of air and steam injected, temperature, pressure, and rotating speed of the plates within the thermal conversion reactor.

11. The system of claim 9, wherein the system further includes:

an infeed hopper configured to be operable for feeding waste to the single screw extruder infeed;

a flare coupled with the thermal conversion reactor thereby allowing the thermal conversion reactor to discharge to the flare, the flare configured to be operable for reducing flame and emissions;

a scrubber configured to be operable for further purifying the process gas to remove water, providing process buffer capacity, and/or for separating liquid and solid particulate matter;

one or more coalescers/filter separators configured to be operable for filtering crude oil byproduct from the process gas and/or for further separating solids and liquids from the process gas;

a compressor configured to be operable for compressing the process gas;

a compressed gas storage tank configured for receiving and storing compressed process gas from the compressor; and a microturbine genset configured for receiving the process gas from the compressed gas storage tank for producing electricity.

12. A system for thermally converting plastic waste into electrical energy, the system comprising the thermal conversion reactor of claim 1 and a controller configured to be operable for allowing various user inputs to be entered and/or selected for customization of different operational parameters of the system when used for thermally converting plastic waste into electrical energy.

13. The system of claim 12, wherein the controller is configured to be operable for monitoring and controlling the different operational parameters within the thermal conversion reactor, including one or more of dwell time, amount of air and steam injected, temperature, pressure, and rotating speed of the =plates within the thermal conversion reactor.

14. The system of claim 13, wherein:

the system includes a generator; and the controller is configured to be operable for controlling the different operational parameters within the thermal conversion reactor to thereby allow process gas to properly be produced by the thermal conversion reactor that meets acceptable levels needed to run the generator for the generation of electrical power.

15. The thermal conversion reactor of claim 1, wherein the thermal conversion reactor comprises a gasifier configured to be operable for thermally converting plastic waste into process gas, which is subsequently conditionable for use as a fuel by a generator for the generation of electrical power.

16. The thermal conversion reactor of claim 1, wherein the thermal conversion reactor is configured to be usable in a system for thermally converting plastic waste into process gas for use as a fuel by a generator for the generation of electrical energy.

17. The thermal conversion reactor of claim 6, wherein the vertical misalignment or offset of the first, second, and third openings is configured to slow down the conveyance of the feedstock downwardly through the thermal conversion reactor via the first, second, and third openings, thereby increasing a dwell time of the feedstock within the thermal conversion reactor.

18. The thermal conversion reactor of claim 1, wherein:

the plates comprises at least a first plate and a second plate;

the first plate includes first openings extending downwardly therethrough; and the second plate includes second openings extending downwardly therethrough, the second openings vertically misaligned with or offset from the first openings of the first plate;

whereby the vertical misalignment or offset of the first and second openings is configured to slow down the conveyance of the feedstock downwardly through the thermal conversion reactor via the first and second openings as the first and second plates are axially rotated about the vertical axis within the reaction chamber of the thermal conversion reactor, thereby increasing a dwell time of the feedstock within the thermal conversion reactor.

19. The thermal conversion reactor of claim 18, wherein the plates comprises multiple plates configured to provide additional surface area for heat transfer to the feedstock as the feedstock is conveyed downwardly through the thermal conversion reactor via the feedstock falling downwardly through and/or being gravity fed through one or more openings of an upper plate and onto a lower plate therebelow as the upper and lower plates are axially rotated about the vertical axis within the reaction chamber of the thermal conversion reactor.

* * * * *